US005355107A

United States Patent [19]

Hwang et al.

[11] Patent Number: 5,355,107

[45] Date of Patent: Oct. 11, 1994

[54] DEFLECTION YOKE WITH LEAKING MAGNETIC FIELD PREVENTION COILS

[75] Inventors: Sungku Hwang, Seoul; Changsik Kang, Kyunggi-do; Samkyeong Lee, Kyunggi-do; Sanghyuk Yeun, Kyunggi-do, all of Rep. of Korea

[73] Assignee: Samsung Electron Devices Co., Ltd., Kyunggi-do, Rep. of Korea

[21] Appl. No.: 981,871

[22] Filed: Nov. 25, 1992

[30] Foreign Application Priority Data

Dec. 6, 1991 [KR] Rep. of Korea ..... 91-22324
Jun. 15, 1992 [KR] Rep. of Korea ..... 92-10659[U]

[51] Int. Cl.[5] ..... H01H 5/00; H01J 29/06
[52] U.S. Cl. ..... 335/214; 315/8
[58] Field of Search ..... 335/210-214; 315/8; 313/440; 358/248, 249

[56] References Cited

U.S. PATENT DOCUMENTS 4,853,588 8/1989 Ohtsu et al. ..... 313/440
5,017,900 5/1991 Ura et al. ..... 335/210
5,049,847 9/1991 Okuyama et al. ..... 335/214
5,124,613 6/1992 Park et al. ..... 313/440
5,191,307 3/1993 Hashimoto et al. ..... 335/214
5,220,241 6/1993 Kanazawa et al. ..... 313/440

*Primary Examiner*—Gerald P. Tolin
*Assistant Examiner*—Ramon M. Barrera
*Attorney, Agent, or Firm*—Christie, Parker & Hale

[57] ABSTRACT

The present invention is relative to a deflection yoke in which a leaking magnetic field preventing member is formed without a magnetic body, such that coil winding parts are formed opposite to and apart from each other at a predetermined distance in the inside of a case formed in the same curvature as that of a flange part of a separator and coils of a predetermined diameter are wound therearound at a predetermined number of turns; a current which can form the current of direction contrary to a magnetic field generated from a horizontal deflection coil supplied therewith; and a leaking magnetic field preventing member in which a cover having a plurality of heat emitting holes fixed on the case is combined with a flange part in the form of corresponding a horizontal deflecting coil by combining an attaching part of the case with a corresponding part of the flange part.

1 Claim, 6 Drawing Sheets

DEFLECTION YOKE WITH LEAKING MAGNETIC FIELD PREVENTION COILS

FIELD OF THE INVENTION

The present invention relates to a deflection yoke and, more particularly to a deflection yoke where a magnetic body is not used so as not only to reduce the cost but also to prevent the introversion of a picture caused by the strong electric field incurred from the magnetic body during its use.

BACKGROUND OF THE INVENTION

Generally, a cathode ray tube is provided with a panel where a phosphorescent layer is formed and a shadow mask is attached; a funnel where, a graphite is layered at the inside and outside surface; and a neck where an electron gun is received and a deflection yoke is attached to its periphery. The deflection yoke is provided with a pair of separators made of a resin; a horizontal deflecting coil which is attached to the inside surface; and a vertical deflecting coil which is attached to its outside surface.

The horizontal and vertical deflecting coils generate horizontal and vertical deflecting magnetic fields, in order to deflect an electron beam emitted from the electron gun to the screen corner. The horizontal and vertical deflecting coils are formed by the winding of a coil.

The deflected electron beam strikes the phosphorescent layer so as to reproduce the picture. However, after deflecting, the fields generated in the horizontal and vertical coils of the deflection yoke for deflecting the electron beam do not remain at each coil but flow out, so that unnecessary leaking magnetic fields range over the whole front face of a screen and are harmful to the human body as well. Accordingly, in a conventional ST (saddle toroidal) type deflection yoke, current is supplied with the coils wound on the periphery of the panel, so that reverse magnetic fields incurred therefrom reduce the leaking magnetic fields generated from the outside.

While the vertical deflecting coil causes little leaking the magnetic field is not harmful to the health. However, the horizontal deflecting coil produces much leaking and the magnetic field is harmful to the human body. The above reverse magnetic field acts against the horizontal deflecting coil to reduce the leaking magnetic field. However, in an improved SS (saddle saddle) type deflection yoke, current which can produce the magnetic field of the direction contrary to that from the horizontal deflecting coil is applied to a member for preventing the leaking magnetic field provided with a predetermined type bobbin fixed on the deflection yoke body and the magnetic body formed by winding the coils inserted in the bobbin, so that the reverse magnetic field generated therefrom can diminish the leaking magnetic field from the horizontal deflecting coil.

The deflection yoke to which the leaking magnetic field preventing member is applied is disclosed in U.S. Pat. No. 5,017,900. As shown in FIG. 8, a pair of cancellation coils 51, 51' installed in the vertical and horizontal direction opposite each other along the imaginary axis passing the central axis of a core 50 are arranged in the vicinity of a front end section of the vertical deflection coils 52, 52'. The cancellation coils 51, 51' are mounted in such a way that their central axis crosses the central axis of the core 50 at an angle $\theta$. These cancellation coils 51, 51' are connected either in series or in parallel with the horizontal deflection coils 53, 53' and, also, each is wound on the magnetic body.

As shown in FIG. 9, U.S. Pat. No. 4,853,588 proposes the deflection yoke 50 that auxiliary coils 54, 54' are connected in series or in parallel to the horizontal deflection coils 55, 55' to generate the cancelling magnetic field which suppresses part of the externally leaking magnetic field radiated from the deflection yoke. However, these auxiliary coils 54, 54' are wound on the magnetic body as well.

As described above, the coils 51, 51', 54, 54' are wound on the magnetic body and the reverse magnetic field generated therefrom reduces the leaking magnetic field. However, the strong magnetic field radiated from the magnetic body itself diminishes the leaking magnetic field and at the same time, has an effect on the deflecting angle of the beam so as to cause the picture introversion of about 25 $\mu$m. The use of the magnetic body results in a relatively high production cost.

SUMMARY OF THE INVENTION

Accordingly, an object of the present invention is to provide a deflection yoke of a cathode ray tube which can prevent high production cost when a magnetic body is used in a leaking magnetic field preventing member for reducing a leaking magnetic field generated from a horizontal deflecting coil of a deflection yoke of a cathode ray tube.

To achieve the object, the present invention proposes a deflection yoke in which a leaking magnetic field preventing member is formed without a magnetic body, such that coil winding parts are formed opposite to and apart from each other at a predetermined distance in the inside of a case the case is formed with in the same curvature as that of a flange part of a separator, and coils of a predetermined diameter are wound around the coil winding parts at a predetermined number of turns. A current, which can form the current of direction contrary to a magnetic field generated from a horizontal deflection coil, is supplied to the coil inside the case of the leaking magnetic field preventing member. The case has a cover with a plurality of heat emitting holes and the case is combined with a flange part in of corresponding position to a horizontal deflecting coil by combining an attaching part of the case with a corresponding part of the flange part.

BRIEF DESCRIPTION OF THE DRAWINGS

Further advantages and other objects of the present invention will be apparent in the following detailed description in connection with the accompanying drawings, in which.

DETAILED DESCRIPTION OF A PREFERRED EMBODIMENT

Figure 1:
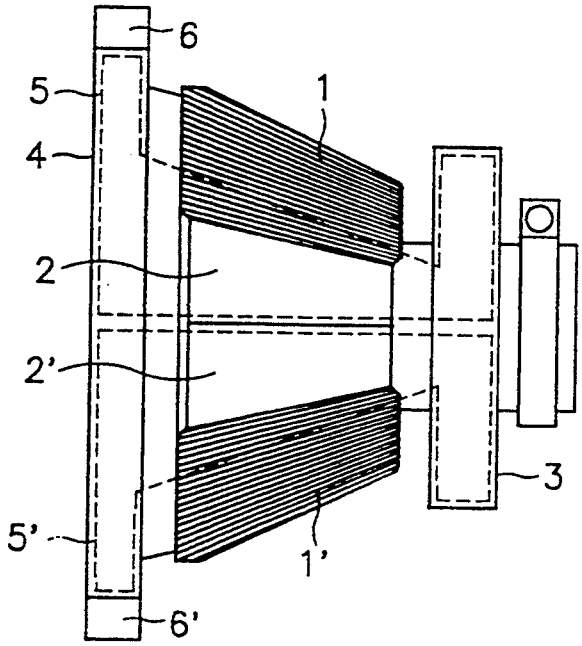
FIG. 1 is a front view of a deflection yoke provided with a leaking magnetic field preventing member of the present invention.
Figure 2:
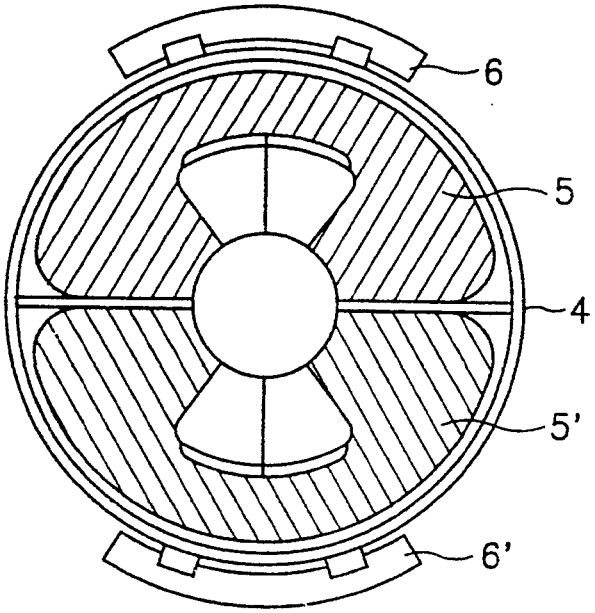
FIG. 2 is a side view of FIG. 1.

FIG. 1 illustrates a front view of a deflection yoke provided with a leaking magnetic field preventing member of the present invention. FIG.2 is a side view thereof. Vertical deflecting coils 1, 1' wound on ferrite cores 2, 2' are closely adhered to the surroundings of a separator 3. Leaking magnetic field preventing members 6, 6' are attached opposite each other on a flange part 4 corresponding to horizontal deflecting coils 5, 5' closely adhered to the inner surface of the separator 3.

Figure 3:
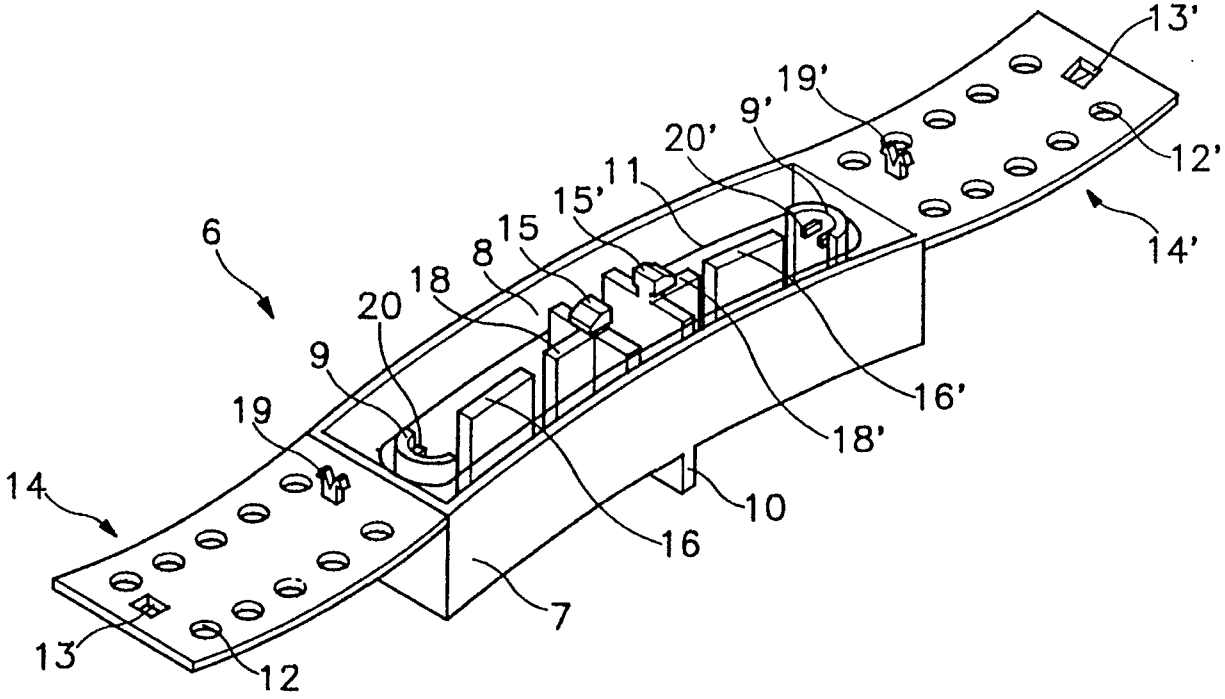
FIG. 3 is a perspective view of one embodiment of the present invention.

As shown in FIG. 3, the leaking magnetic field preventing members 6, 6' attached to the flange part 4 of a deflection yoke are such that semicircular coil winding parts 9, 9' are installed facing each other in a space 8 formed in a case 7 having the same curvature as that of the separator 3. A projection 10 from case 7 adhered to the flange part 4 maintains the distance between the separator 3 and the leaking magnetic field preventing members 6, 6' which are formed on the one side of the case 7. Covers 14, 14' in which cover hanging holes and a plurality of heat emitting holes 12 emitting the heat generated from a coil 11 wound on the coil winding parts 9, 9' are provided at and connected to respective ends of the case. Cover hangers 15, 15', which fix the covers 14, 14', are formed at the inside of the case 7 and supporting means 16, 16' for supporting the covers 14, 14' and are formed facing each other at the middle part of the case 7.

Figure 4:
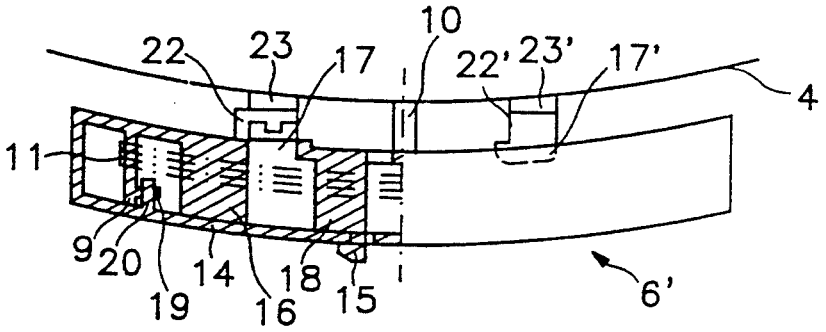
FIG. 4 is a half-sectional view of a leaking magnetic field preventing member attached to a separator.

Coil 11 is wound on the coil winding part 9,9' at a predetermined number of turns and the covers 14, 14' are closely fixed to the case 7. As shown in FIG. 4, the case is attached to the flange part 4 of the separator 3 corresponding to the horizontal deflecting coils 5, 5' positioned at the inside surface of the separator 3. The coil 11 is drawn out through coil drawing holes 17, 17' and is supplied with current in a direction contrary to that of the horizontal deflecting coils 5 5' so as to form a magnetic field in the direction contrary to that of the horizontal deflecting coils 5, 5'.

Figure 5:
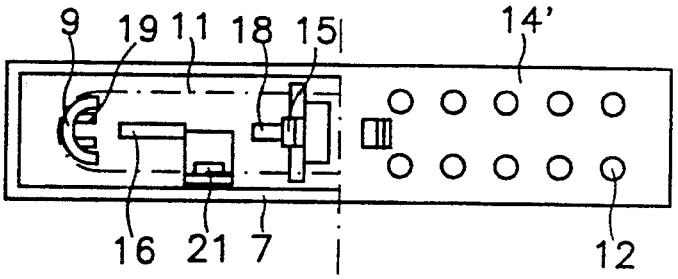
FIG. 5 is a plan view of an assembly state of a cover in FIG. 2.

At that time, as shown in FIG. 5, the coil 11 is wound on the coil winding parts 9, 9' facing each other, preferably with 16 to 20 loops. The covers 14, 14' are closely fixed on the case 7, so that cover hanging holes 13, 13' hang from the cover hangers 15, 15' for the cover to be fixed and at the same time, the covers 14, 14' are supported by the supporters 18, 18' extending from the cover hangers 15, 15'.

Specifically, the leaking magnetic field preventing members 6, 6' can remove the introversion of a picture caused by an improper beam deflecting angle by the strong magnetic field of a magnetic body since, without the magnetic body, the coil 11 is wound on the coil winding parts 9, 9', so that the only magnetic field generated from the current supplied to the coil 11 is used in the cancellation of the leaking magnetic field.

The case 7 having the same curvature as that of the separator 3 is formed because, if the leaking magnetic field is measured at 50 cm apart from the face of the cathode ray tube, the cancellation effect of the leaking magnetic field is improved 35.8 n/T to 6.8 n/T over that of the plate type case 7.

The covers 14, 14' on the case 7 are formed in the half size compared with that of the case 7, so that they can open and close in the direction of both sides. Of course, when a cover having the same size as that of the case is used, and has either the same curvature as the case 7 or is of the plate type, the same effect can be obtained.

Also, the number of turns of the coil 11 wound in the case 7 is from 16 to 20 times and the diameter of the coil 11 is 0.46 to 0.50 mm so as to improve the cancellation effect of the leaking magnetic field.

At that time, the reason for setting the number of turns at 16 to 20 times is that, if more or less than that is used, the cancellation effect is reduced. The reason for limiting the diameter of the coil from 0.46 to 0.5 mm is that, if more or less than that is used, while the cancellation effect is the same, the increasing of the section area of the coil results in the increasing of the resistance so as to increase the heat and, because of the use of the thick coil, the cost is raised as well.

The inner surface of the center part of the covers 14, 14' is supported by the supporting means 16, 16' extending from the case 7. Wedges 19, 19' are formed on the inner surface of the covers 14, 14' near the connecting part of the case 7. Combining parts 20, 20' for mating with and supporting the wedges 19, 19' are formed at the inside of the semicircular winding parts 9, 9'.

In the supporters 14, 14' and the cover hangers 18, 18', the combining part with the covers 14, 14' is formed in the same curvature as that of the covers 14, 14' so that the covers 14, 14' will be securely fixed.

The wedges 19, 19' are divided into two. When they are inserted into the combining part, they are biased toward the closed position to compress the combining parts 20, 20' so that the wedges 20, 20' are not readily removed from the combining part 20, 20'.

When the covers 14, 14' fall down due to the external vibrations or impact that compresses the coil 11 and changes the magnetic field of the coil 11, the cancellation effect of the leaking magnetic field is reduced. Accordingly, to support the covers 14, 14' the supporting means 16, 16' and the supporting parts 18, 18' are formed at the center part of the case there the cover hangers 15, 15' are so that, the above-reduced cancellation effect can be overcome.

Figure 6:
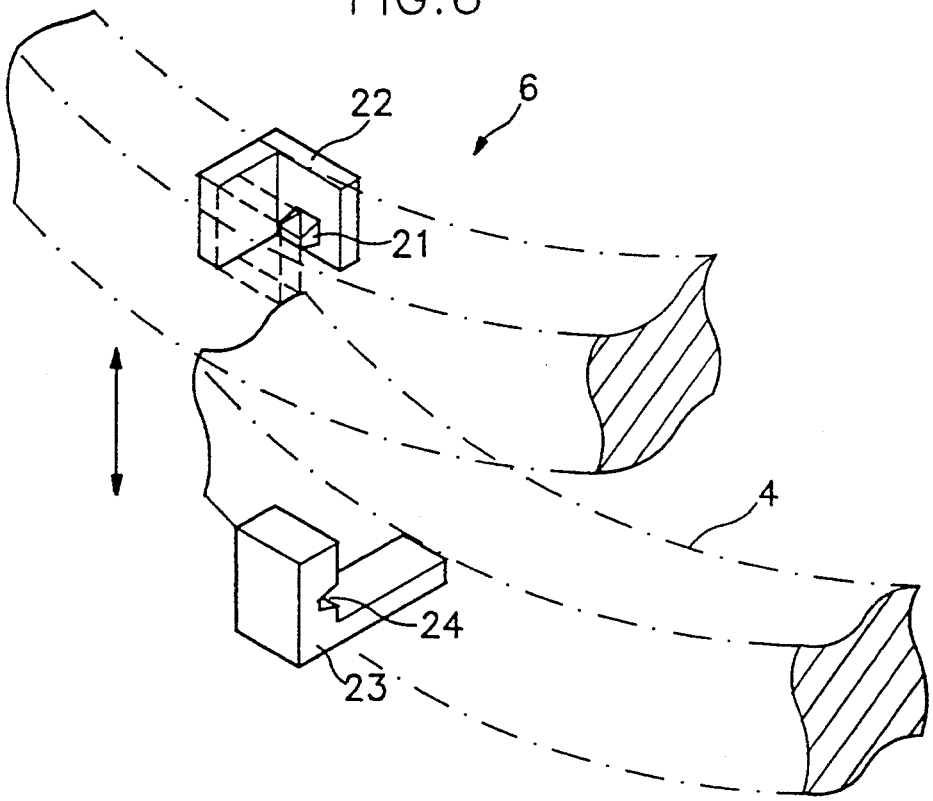
FIG. 6 is a partial enlarged perspective view of an assembly state of a leaking magnetic field preventing member and a separator.

In the above leaking magnetic field preventing member, as shown in FIG. 6, these are attaching parts 22, 22' which have projections 21, 21' formed apart from each other on the end part of the case 7. Corresponding parts 23, 23' are formed opposite to the attaching parts 22, 22' on the flange part 4.

Grooves 24, 24', in which the projections 21, 21' can be inserted, are formed in the corresponding parts 23, 23'. When the attaching parts 22, 22' are combined with the corresponding parts 23, 23' the grooves are expanded equal to the projecting length of the projection 21 due to self elasticity. When projection 21 is inserted in groove 24, the groove is closed up so as to combine the projection and the groove. Thus, the leaking magnetic field preventing members 6, 6' are securely fixed to the flange part 4 of the deflection yoke.

The grooves 24, 24' of the corresponding parts 23, 23' are formed at a position designed, so that, when the leaking magnetic field preventing members 6, 6' are fixed, the best cancellation effect can be obtained.

Figure 7:
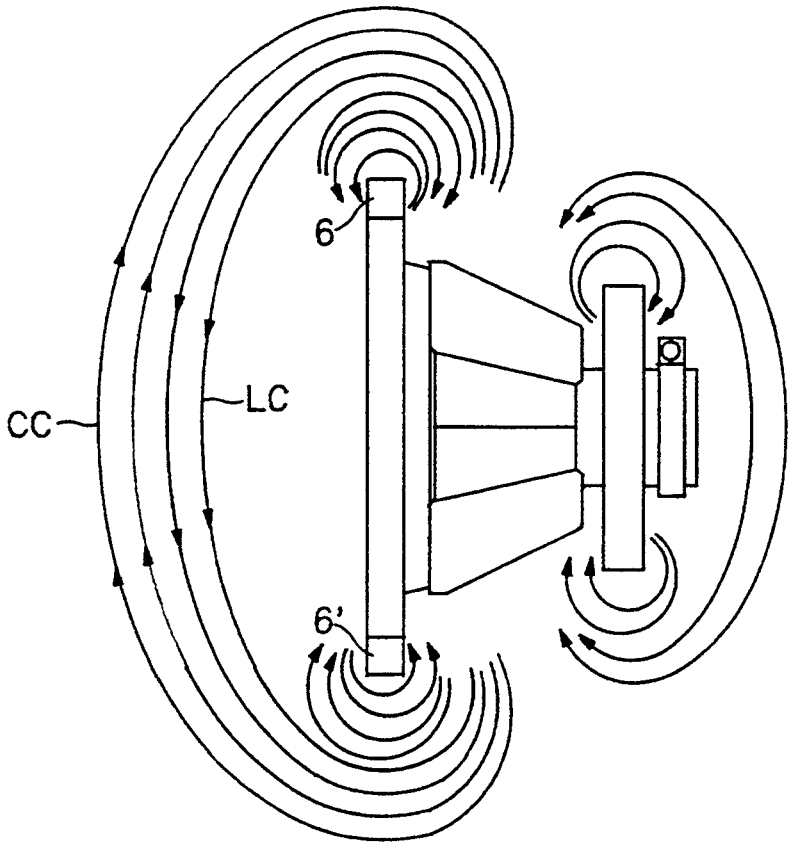
FIG. 7 is a schematic view of a magnetic field generated from a leaking magnetic field preventing member and a horizontal deflecting coil.
Figure 8:
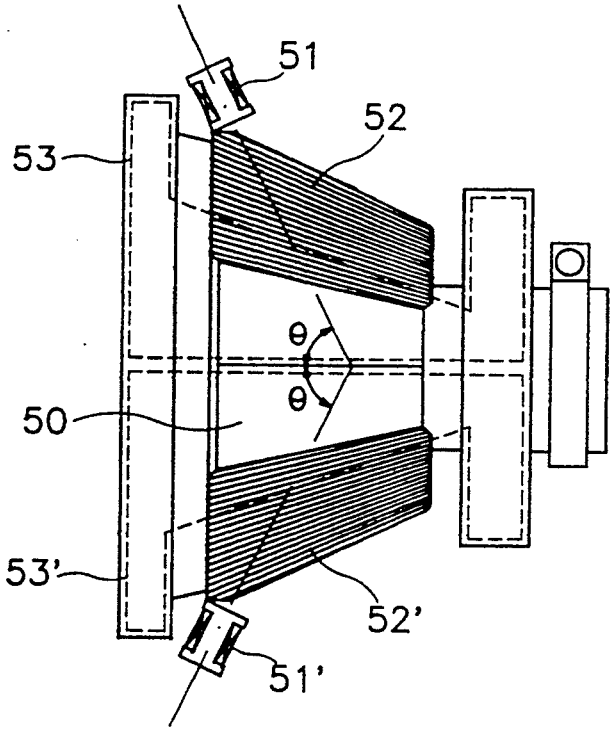
FIG.8 (Prior Art)
FIG. 8 is a front view of one embodiment of a deflection yoke provided with a conventional leaking magnetic field preventing member.
Figure 9:
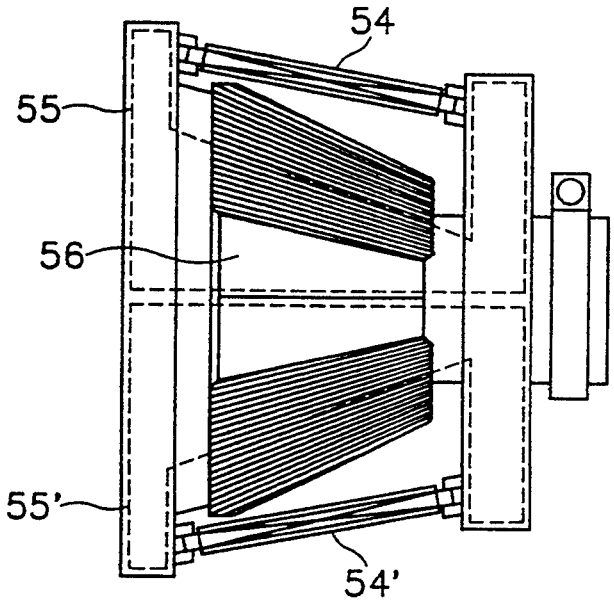
FIG.9 (Prior Art)
FIG. 9 is a front view of the embodiment of a deflection yoke provided with a conventional leaking magnetic field preventing member.

As shown in FIG. 7, the deflection yoke provided with the leaking magnetic field preventing members 6, 6' is such that the magnetic field CC in a direction opposite to the leaking magnetic field LC generated from the horizontal deflecting coils 5, 5' is formed by the leaking magnetic field preventing members 6, 6' to reduce the leaking magnetic field LC.

Figure 10:
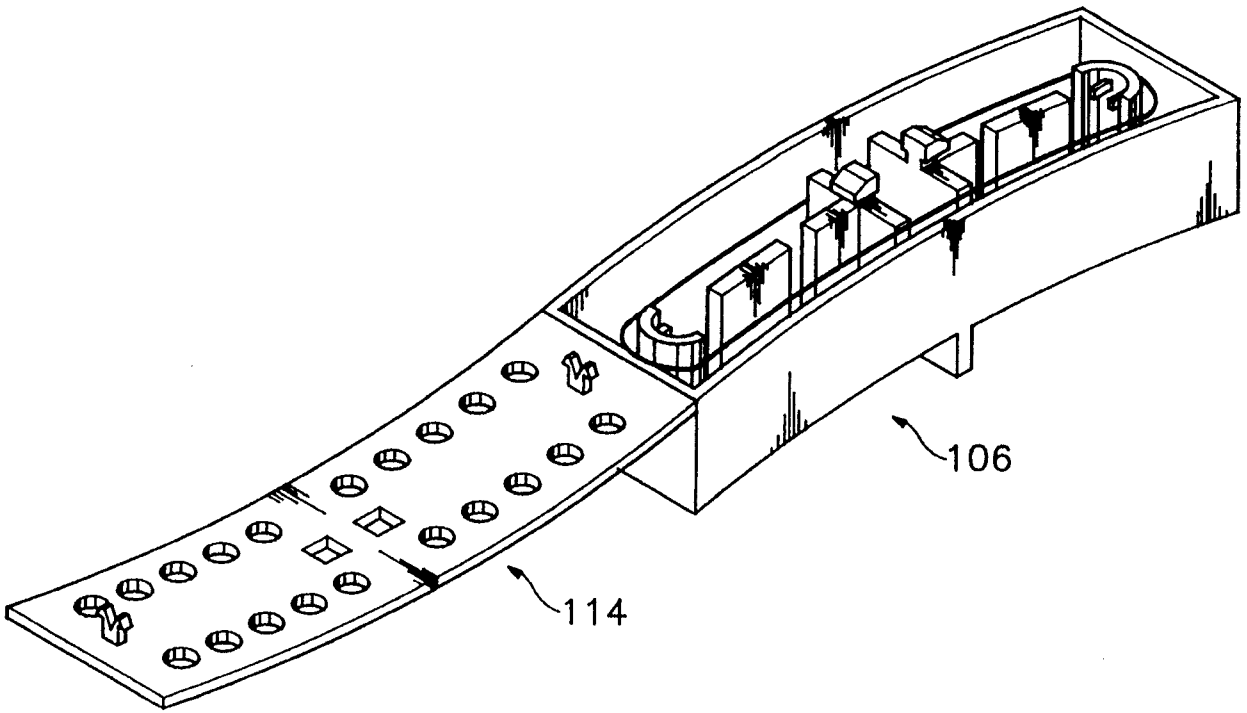
FIG. 10 is a view similar to FIG. 3 but of another embodiment where the cover is in one piece.

As shown in FIG. 10, the cover 114 may be made in one piece for each case, and each case 106 is otherwise the same as in FIG. 3.

Accordingly, as described above, the present invention has advantages such that, according as, without the use of magnetic body on which the coil is wound, the coil is wound on the coil winding parts which are formed opposite each other in the case and the supporting parts and supporting structures supporting the inner surface of the cover covering the open side of the case formed in the case and the cover hanger, the introversion of the screen according to the use of the magnetic body can be prevented; the production cost can be reduced; and also the change of the magnetic field generated from the coil due to the cover falling down can be prevented.

What is claimed is:

1. A deflection yoke comprising:

a leaking magnetic field preventing member for creating a magnetic field in a direction contrary to that of a leaking magnetic field from a horizontal deflecting coil, the leaking magnetic field preventing member comprising a pair of coils disposed on opposite sides of and facing a flange part of the deflection yoke centering around the center axis of the deflection yoke;

a pair of cases, each case for receiving one of the coils, each case comprising coil winding parts disposed on side ends of a space formed in the case, each of the coil winding parts being formed in a semicircular shape;

coil drawing holes formed by penetrating the bottom of the coil winding parts for drawing out the coil in the case when the coil is wound on the coil winding parts and thus both side ends of the coil are electrically connected;

attaching parts formed on the case for fixing the case on a corresponding part formed on the flange part;

cover means for covering the open part of the case connected to the case so as to be rotatable outwardly;

cover supporting means formed in the space in the case for supporting the cover means;

engaging means formed in the cover means and corresponding to the cover supporting means for fixing the cover means on the cover supporting means; and a plurality of heat emitting holes formed in the cover means to emit the heat generated from the coil, wherein a combining part is formed on each of the coil winding parts, and wedges for attaching each said combining part, respectively are formed on the cover means at a position corresponding to each said combining part.

* * * * *